US006574818B1

(12) United States Patent
Matiere

(10) Patent No.: US 6,574,818 B1
(45) Date of Patent: Jun. 10, 2003

(54) PROVISIONAL BRIDGE OF PREFABRICATED ELEMENTS

(75) Inventor: Philippe Matiere, Raulhac (FR)

(73) Assignee: Societe Civile de Brevets Matiere, Aurillac (FR)

( * ) Notice: Subject to any disclaimer, the term of this patent is extended or adjusted under 35 U.S.C. 154(b) by 0 days.

(21) Appl. No.: 09/714,906

(22) Filed: Nov. 17, 2000

(30) Foreign Application Priority Data

Nov. 19, 1999 (FR) ..... 99 146606

(51) Int. Cl.[7] ..... E01D 21/00
(52) U.S. Cl. ..... 14/77.1; 14/73
(58) Field of Search ..... 14/73, 73.1, 77.1, 14/69.5; 52/650.3

(56) References Cited

U.S. PATENT DOCUMENTS

| | | | | | |
|---|---|---|---|---|---|
| 2,033,751 | A | * | 3/1936 | Yeager | 72/66 |
| 3,257,764 | A | * | 6/1966 | Cripe | 52/252 |
| 3,800,490 | A | * | 4/1974 | Conte | 52/250 |
| 3,912,408 | A | * | 10/1975 | Domnick | 44/35 |
| 4,373,837 | A | * | 2/1983 | Lin et al. | 405/218 |
| 4,531,857 | A | * | 7/1985 | Bettigole | 404/44 |
| 4,706,319 | A | * | 11/1987 | Sivachenko et al. | 14/73 |
| 4,741,138 | A | * | 5/1988 | Rongoe, Jr. | 52/334 |
| 4,825,492 | A | * | 5/1989 | Zehavi et al. | |
| 4,965,903 | A | * | 10/1990 | Bisch | 14/1 |
| 4,972,537 | A | * | 11/1990 | Slaw, Sr. | 14/1 |
| 5,311,629 | A | * | 5/1994 | Smith | 14/73.1 |
| 5,331,700 | A | * | 7/1994 | Karcher et al. | 14/2.4 |
| 5,339,475 | A | * | 8/1994 | Jaeer et al. | 14/73 |
| 5,418,992 | A | * | 5/1995 | Alten | 14/69.5 |
| 5,454,128 | A | * | 10/1995 | Kwon | 14/73 |
| 5,617,599 | A | * | 4/1997 | Smith | 14/73 |
| 5,623,803 | A | * | 4/1997 | Willis | 52/650.3 |
| 5,867,854 | A | * | 2/1999 | Matteo et al. | 14/73 |
| 5,901,396 | A | * | 5/1999 | Ahlskog et al. | 14/77.1 |
| 5,906,084 | A | * | 5/1999 | Millington et al. | 52/650.3 |
| 5,920,938 | A | * | 7/1999 | Elcock et al. | 14/77.1 |
| 6,055,693 | A | * | 5/2000 | Lehr et al. | 14/73 |
| 6,073,293 | A | * | 6/2000 | Ahlskog et al. | 14/73 |

FOREIGN PATENT DOCUMENTS

| | | |
|---|---|---|
| DE | 1 033 94 | 6/1956 |
| DE | 26 00 662 A1 | 1/1976 |
| DE | 28 12 531 B1 | 3/1978 |
| EP | 0 490 771 A1 | 6/1992 |

* cited by examiner

*Primary Examiner*—Thomas B. Will
*Assistant Examiner*—Raymond W Addie

(57) ABSTRACT

A metal bridge includes at least two longitudinal girders connected by a plurality of transversal spacers and on which rests a platform. Each longitudinal girder is built by butt-jointing a number of prefabricated metal elements in the form of tubular hollow coffers of polygonal transversal section, each extending over a length compatible with transport and lifting devices. At least certain coffers of two neighboring girders are connected in twos by a plurality of spacers, each composed of a metal tube.

12 Claims, 7 Drawing Sheets

PROVISIONAL BRIDGE OF PREFABRICATED ELEMENTS

FIELD OF THE INVENTION

The invention relates, generally, to the realization of metal bridges with average span length, for example a few multiples of ten meters, but it is especially suited to the construction of provisional bridges intended for military usage or to rapid rebuilding of a destroyed bridge.

BACKGROUND OF THE INVENTION

During military operations, it is often necessary to realize overpasses for rivers or valleys or to rebuild bridges rapidly, which have been, at least partially, destroyed.

Provisional constructions are entrusted to military civil engineering units. For average span lengths, with a few multiples of ten meters, provisional bridges composed of prefabricated elements are often available and can be implemented by a team of a few men. This type of bridge, called a 'Bailey' bridge in France, comprises longitudinal structural elements made of light lattice girders and transversal elements supporting a flooring. Taking into account the large number of elementary parts, implementing a Bailey bridge takes relatively long and the result is not really aesthetic, but this is irrelevant in the case of military operations.

However, military civil engineering units have been led, for quite some time, to operate in regions having suffered from war conditions, for the rebuilding of infrastructures, in particular overpasses, which have often been destroyed. Often, only the bridge deck has been cut off, whereas the abutments and the piers are still in position.

In order to restore communications rapidly, it appears interesting to use the provisional bridge elements available to the army of the country affected, but that equipment is not often provided in sufficient quantity. Moreover, the bridges that have been rebuilt in such a fashion are intended to remain in place for a long period, until complete rebuilding of the civil engineering works and it is not superfluous to cater for their external aspect as far as possible.

Besides, 'Bailey'-type bridges were designed to be implemented manually by a few men. Still, the civil engineering units are, at the moment, fitted with lifting means whose capacity may generally be 4 or 5 tons, and it is therefore interesting to change the design of the provisional bridges while taking the current possibilities into account.

The invention therefore relates to a new bridge deck that, like dismountable bridges known previously, is composed of prefabricated elements assembled on site, but whose installation, using lifting devices, can be particularly fast, whereas such a deck may have, moreover, a longer span length than the provisional bridges known so far.

Furthermore, the bridge deck according to the invention exhibits an external aspect similar to that of a bridge built in a conventional fashion. A provisional bridge according to the invention may thus be easily turned into permanent civil engineering works.

Besides, thanks to its multiple advantages, the invention is not limited to the realization of provisional bridges, but can also be applied advantageously to the realization of any overpass with average span length.

The invention relates therefore, generally, to the realization of a deck for a metal bridge whereby at least one span rests on two supports, the deck comprising at least two main girders parallel to the longitudinal direction of the bridge and connected by a plurality of transversal spacers at a distance from one another and a transversal flooring resting on the longitudinal main girders.

According to the invention, each longitudinal girder is built by butt-jointing of a number of prefabricated metal elements, each formed of a tubular hollow coffer with polygonal transversal section with at least one plane upper face, whereas the coffers exhibit the same section and each extending over a length compatible with the transport and lifting means. Moreover, the coffers of two adjacent girders are connected in twos by a plurality of spacers, each composed of a metal tube with two ends each fitted with fastening means with one lateral face of a coffer and the girders are connected, at their upper part, by a plurality of rigid transversal junction elements making up at least a portion of the flooring and with two ends fastened respectively to the upper plane faces of the coffers of both girders.

Advantageously, each coffer forming an element of a longitudinal girder exhibits a quadrangular and, preferably trapezoid, transversal section, with two horizontal faces of different widths and two lateral faces tilted symmetrically with respect to a vertical middle plane of the coffer.

In a first embodiment of the invention, the transversal junction elements are composed of a series of profiles spaced apart from one another and extending transversally over a length at least equal to the distance between two girders, whereas the profiles have each two ends fastened respectively on the plane upper faces of the corresponding coffers of both girders.

Preferably, the junction profiles are spaced apart by a constant distance corresponding to the width of a timber span placed between two neighboring profiles and resting on the upper plane faces of the corresponding coffers of both longitudinal girders, whereas a provisional flooring is composed of a series of spans placed beside one another.

According to another advantageous characteristic, the bridge deck comprises a series of undulated panels extending between two longitudinal girders and resting on the upper faces of the corresponding coffers of the girders, whereby the panels abut one another and compose formwork for casting a concrete slab to build the flooring of the bridge deck.

In cases where the provisional flooring is composed of spans placed between junction profiles, it is possible, after removing the spans, to place between both girders, a series of undulated panels nesting over the profiles and making up formwork for the casting of a concrete slab to build the permanent flooring of the bridge deck.

Advantageously, the upper plane face of each coffer is fitted with parts protruding upwards, forming connectors, intended to be embedded in the concrete slab cast in the formwork, for interlocking the slab with the longitudinal girders.

According to another embodiment of the invention, the transversal junction elements are composed of a series of concrete slab elements intended to be butt-mounted, one after another, over at least two series of coffers forming at least two longitudinal girders, while covering the girders, whereas each element of the slab is interlocked, after assembly with the corresponding coffers of both girders, in order to build the flooring of the bridge deck.

The invention also covers a number of advantageous characteristics that will be described in more detail below and that are subject to the claims.

Besides, the invention also covers the prefabricated elements for the construction of a bridge deck and a new method for building a span that comprises such a bridge deck.

But the invention will be described better with the following description of certain embodiments particularly advantageous that are explained for exemplification and non-exhaustive purposes and represented on the appended drawings.

DETAILED DESCRIPTION OF THE INVENTION

Figure 1:
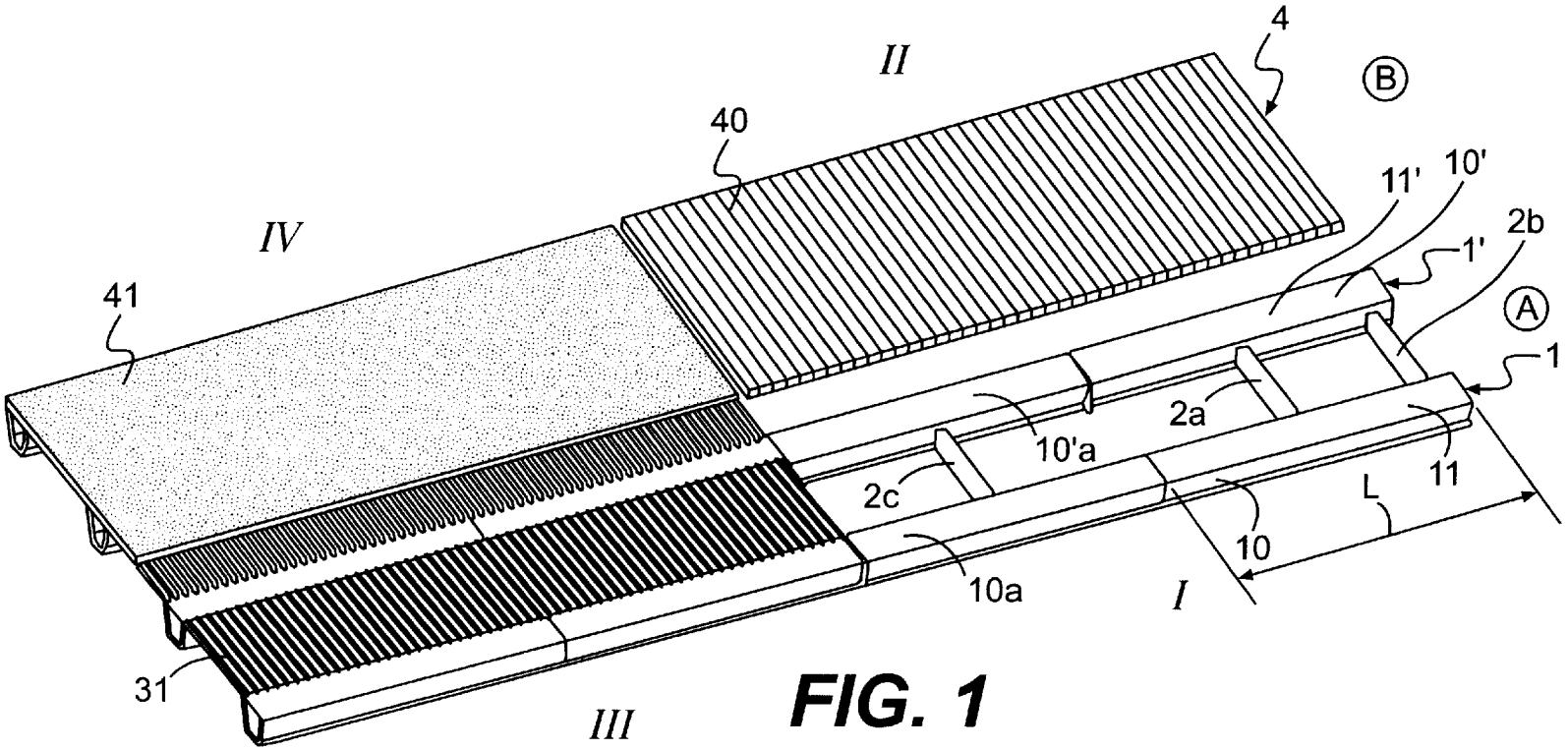
FIG. 1 is a general perspective schematic view of a provisional bridge deck according to the invention.
Figure 2:
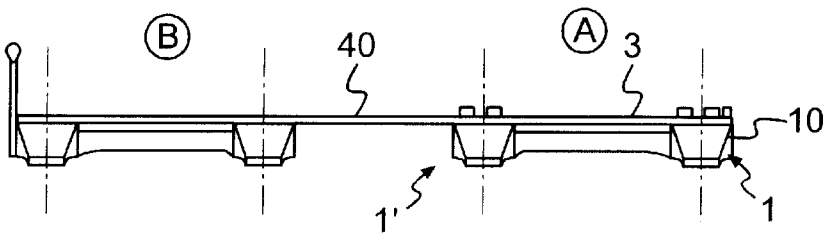
FIG. 2 is a transversal cross section of the bridge deck.

FIG. 1 is a perspective schematic representation, with four construction stages of a bridge deck comprising, on the example represented, two traffic lanes A and B and that is represented as a cross section on FIG. 2. Each traffic lane is supported by two main longitudinal girders 1, 1' that are each formed of a series of tubular coffers 10 butt-welded or butt-bolted and connected together by spacers 2.

Figure 3:
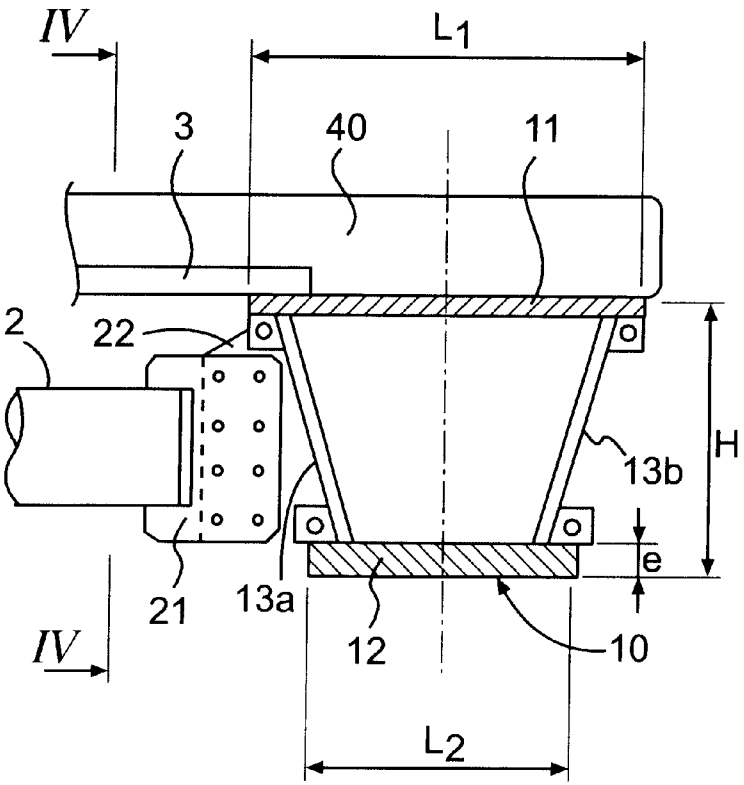
FIG. 3 is a detailed view, as a transversal section, of a coffer at a spacer.

As shown on FIG. 3, each coffer 10 exhibits a quadrangular section, preferably trapezoid, comprising an upper plane face 11, a lower plane face 12 and two lateral faces 13*a*, 13*b* tilted symmetrically with respect to the longitudinal middle plane P1 of the coffer 10. Preferably, the larger base of the trapezoid is turned upward, whereas the upper face 11 is wider that the lower face 12. The thicknesses of the sheets are determined in relation to the loads to sustain, whereas the lower face 12 is, normally, thicker than the upper face 11.

As stated, the bridge deck represented on FIG. 1, is especially suited to the construction of a provisional bridge, in particular by a military engineering unit and is therefore composed entirely of prefabricated elements that can be realized in advance and brought to the site. To build a supporting girder, a series of coffers 10 liable to be butt-mounted as well as a number of spacers 2 are provided, fitted at their ends with fastening means on the lateral faces 13 of the coffers, whereby the number of elements depends on the span length of the span to be realized and on the sizes of the coffers that are determined in relation to the handling means available.

Generally, the length (L) of each coffer 10 corresponds to the possibilities of road transport and, normally, is also suited to transport by rail, air or sea. Indeed, as the place of construction is often isolated, the last portion of the transport will be made by road, generally. In practice, the length of the coffers 10 will not exceed 5 or 6 meters in order to enable their transport on a road trailer and their handling on the site by a lifting vehicle such as those currently available to engineering works and whose lift power is generally 4 or 5 tons.

However, to enable immediate adaptation to the construction situations, a stock of elements, especially coffers 10 exhibiting at least two different lengths (L), for example 2.5 meters and 5 meters, will be available in order to realize, on the site, spans having different span lengths.

Similarly, it will be advantageous to have coffers available that have been made from sheets of different thicknesses in relation to the loads and overloads that depend on the nature of the traffic. In particular, if the coffers are realized in advance, it is interesting to vary the thickness (e) of the lower face 12 in order to be able to select coffers in advance that are capable to sustain the applied loads, taking into account the span length of the span to be realized and the position of the coffer with respect to the supports.

Still, for butt-mounting of the coffers, their external sizes, i.e. their height (H) and the width (11, 12) of the faces, respectively, upper and lower faces, will be, normally, the same so that, during assembly, the walls will be arranged in the alignment of one another, even if their thickness, in particular that of the lower face, may vary.

In practice, several ranges of coffers could be available, for which the height (H) of the coffer 10 could be, respectively, 600, 700, 800 and 900 mm. For each height, there will be 3 or 4 types of coffers for which, for example, the thickness (e) of the lower face could vary from 20 to 75 mm. Thus, the first range of coffers with 600 mm in height will enable realization of spans with a 10 to 20 m span length, whereas the last range, with 900 mm in height, will enable construction of spans with a 20 to 25 m span length.

Obviously, these sizes will be selected in order to maximize the possibilities while using as small a number of coffers as can be in order to cope with the cases when building bridges with average span lengths, i.e. ranging normally between 10 to 30 meters.

It should be noted that the design of the span, in particular the small number of elements and their simplicity, enables assembling them together, for example using bolts. Consequently, it is possible to dismantle the bridge in order to claim the elements, for instance after rebuilding a permanent bridge. Moreover, building using bolts or rivets is easier to perform and does not require as specialized a staff as for welding, which is particularly advantageous for military applications.

The elements shall be assembled conventionally with a metal superstructure. For example, on the example represented on FIG. 3, each end of a spacer tube 2 is fitted, in its middle plane, with a fastening flat 21 resting on a fixed gusset 22, on a transversal plane, on the lateral face 13 of the coffer 17, whereas the flat 21 and the gusset 22 are fitted with orifices that are aligned for mounting the fastening bolts.

As shown on FIG. 1, for the realization of a span for a provisional bridge according to the invention, a certain number of coffer elements, prepared previously, will be brought to the site and they are butt-mounted to form a longitudinal girder 1, whereas certain coffers may be different in length (L) in order to provide a span of the requested length.

If the length of this span is not too great and corresponds to the possibilities of the lifting vehicle available, the coffers can be assembled on the ground in order to build a girder of requested length and the girder can be lifted to rest on the supports. In such a case, two longitudinal girders 1, 1' will be placed beside one another and be then connected by a certain number of spacers 2.

It should be noted that the trapezoid section of the girder reduces the risk of cant and therefore facilitates the assembly.

But, the girders can also be pushed longitudinally while sliding or rolling on their lower side.

Thus, in the example represented on FIG. 1, a first element of span composed of two coffers 10, 10' connected by two spacers, respectively a center spacer 2*a* and an end spacer 2*b*, is assembled.

Once this first element has been placed on a launching yard at requested level, the following coffers 10*a*, 10'*a*, connected by a spacer 2*c*, are fastened to the ends of both coffers 10, 10'. Thus, both longitudinal girders 1, 1' of the span can be built gradually, whereas the girders rest for instance on rollers, by the lower faces 12 and pushed longitudinally as the construction progresses to assemble the whole span.

As indicated above, the adjacent elements 10, 10*a*, can be butt-mounted using bolts, which enables, at a later stage, to dismantle the deck in order to claim the elements.

Figure 4:
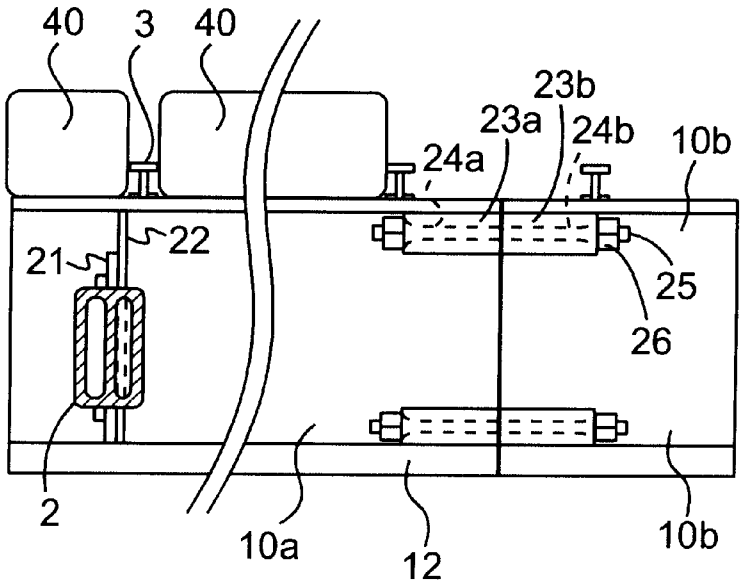
FIG. 4 is a lateral view, along the line IV, IV of FIG. 3, of the link between two successive coffers.

However, it is more advantageous to use the pre-load assembly mode as represented on FIGS. 3 and 4.

In such a case, each coffer 10 forming an element of a longitudinal girder is fitted, at each end, with four massive welded connectors 23, on the external side, to the four angles of the coffer whose sides 11 and 12 have been lengthened laterally. These massive parts 23 are each drilled with a bore 24 so that the parts 23*a*, 23*b* located, respectively, at the opposite ends of two adjacent girders 10*a*, 10*b*, are applied on top of one another, whereas the bores 24*a*, 24*b* are aligned. Preloaded bars with high yield stress 25, loaded and locked for instance by pretension nuts 26, can be inserted into these aligned bores.

Thus it is possible to realize, for example on the bank of a river to be passed, two longitudinal girders 10, 10' that are placed between two supports, for example using a crane or by pushing or.

This first assembly phase I has been represented schematically in the lower right portion of FIG. 1.

Thus, the supporting structure of a first traffic lane A has been formed and it is possible, if needed, to build, beside the lane, a second supporting structure for a second traffic lane B.

To ensure stiffness of each supporting structure, both girders 1, 1' are then interlocked by junction elements such as profiles 3 with a length at least slightly greater than the distance between both neighboring girders 1, 1' and whose ends are fixed to the upper faces 11, 11' of the neighboring girders.

When realizing a provisional bridge, it is then possible to place between the profiles 3 timber beams 40, for example railway ties, thereby providing a provisional flooring 4.

This phase 11 is represented in the upper right portion of FIG. 1.

Thus, a provisional bridge span can be realized rapidly and economically while using simply a lifting vehicle with lifting power of a few tons.

However, according to another advantage of the invention, the provisional bridge built this way, can be turned into a permanent bridge quite easily.

To this end, after removing the beams 40 forming the flooring 4, the space between two neighboring girders 1, 1' is covered with a series of undulated panels 31 placed behind one another, representing phase III, shown on the bottom left portion of FIG. 1. These panels 31 are fitted with transversal undulations that nest into junction profiles 3 fixed to both girders 1, 1'. This provides formwork for casting a slab 41, in a last building phase IV represented in the upper left portion of FIG. 1. Obviously, before casting the concrete, adequate armoring has been placed above the formwork 31.

However, as stated above, the invention is not limited to the building of provisional bridges, but can also be used to realize a conventional metal bridge.

In such a case, the supporting structure composed of at least two longitudinal girders 1, 1' connected by spacers 2 is covered with a concrete platform made of prefabricated slabs that are interlocked with the upper faces of the longitudinal girders 1, 1' in order to ensure a rigid structure.

As previously, each longitudinal girder 1 is composed of a series of prefabricated coffers 10 butt-fastened, for instance pretension bars, as represented on FIG. 4.

Figure 5:
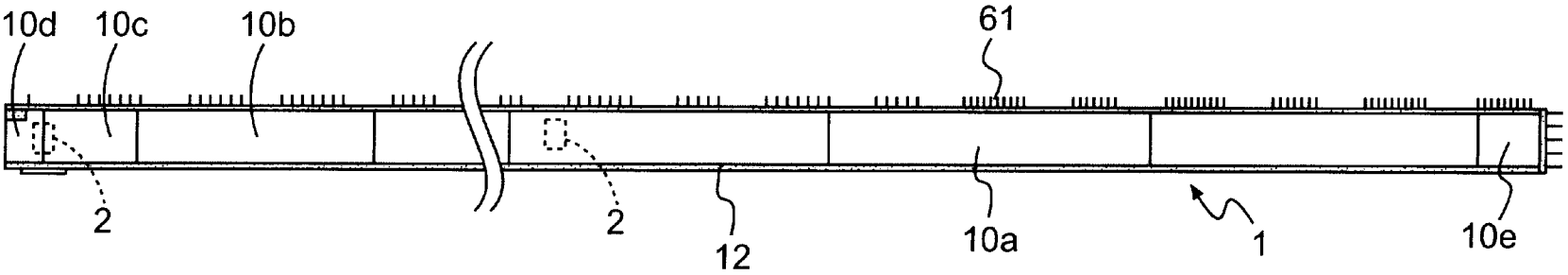
FIG. 5 is a top view of the whole longitudinal girder of a bridge deck.

These coffers are realized in advance and it is advantageous to have several lengths assembled judiciously in relation to the bearing distance. For example, in the embodiment represented on FIG. 5, the girder 1 is made, in its greater portion, of offers 10*a* with, for instance, a 3.50 meter length and is complemented by a certain number of shorter coffers 10*b*, 10*c* with 2.5 and 1 m in lengths. Abutment coffers 10*d*, 10*e* are placed at both ends.

As stated above, both longitudinal girders 1, 1' are connected by spacers 2. Still, as the girders are interlocked permanently by concrete slabs, the number of spacers can be reduced and it may be sufficient, for instance to place simply a spacer at each end of the span and one or two spacers in the center portion.

Besides, it is interesting to have several types of coffers in which the thicknesses of the sheets, in particular for the lower side 12, can vary in relation to the bending moment sustained that depends on the position of the coffer in the span, For instance, as shown on FIG. 2, the coffers located in the center part of the span may have a lower side 12 thicker than for the coffers placed at the ends.

Figure 6:
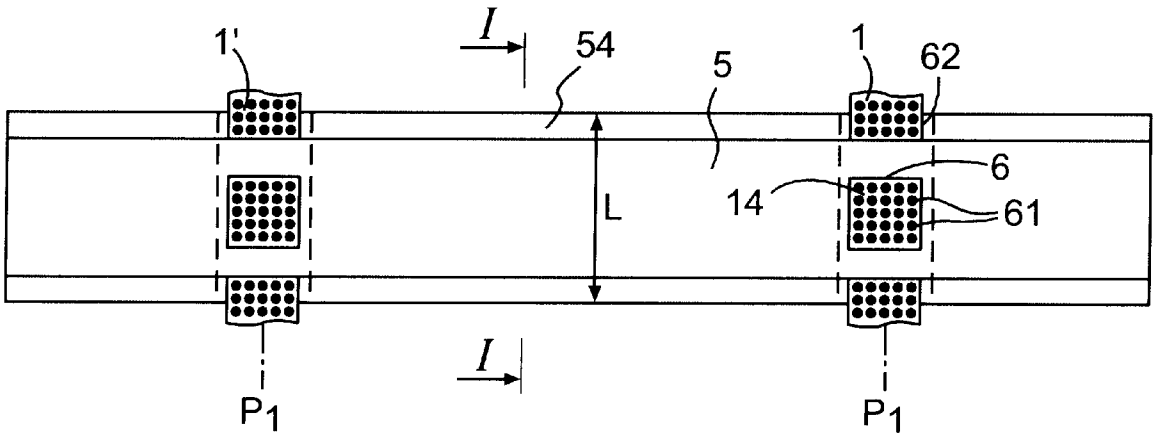
FIG. 6 is an underside view of a prefabricated slab resting on two longitudinal girders.
Figure 12:
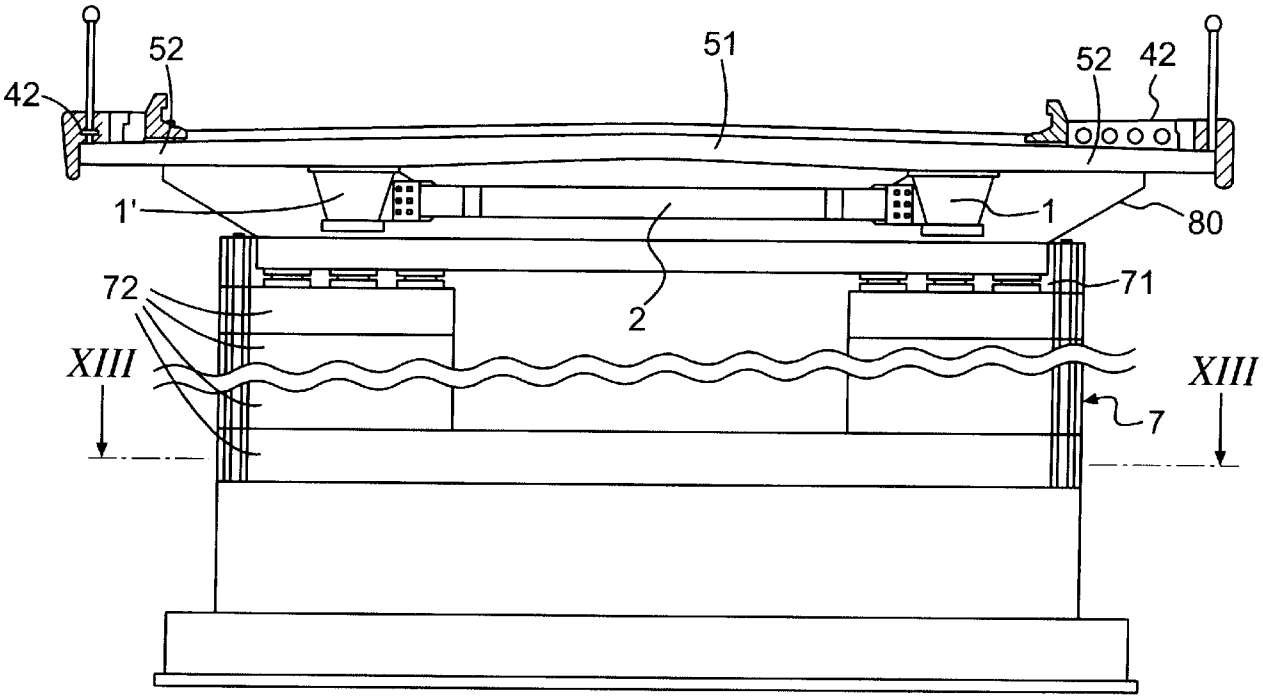
FIG. 12 is a general view, as a partial transversal cross section, of a whole bridge pier.

FIG. 6 shows, seen from beneath, a slab 5 covering two longitudinal girders 1, 1' that is represented as a cross section on FIG. 12. The slab 5 comprises advantageously a center portion 51 extending between both girders 1, 1' and extended, on either side of the girders by two lateral portions 52 on which pavements 42 can be mounted.

Figure 7:
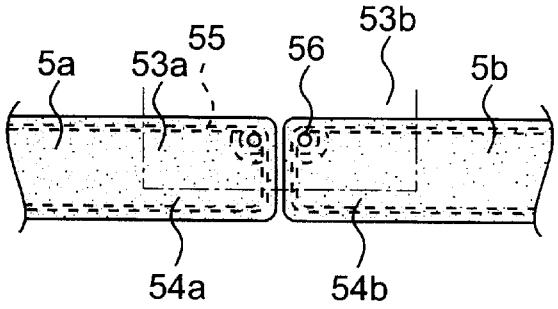
FIG. 7 is a longitudinal cross section of the junction between two adjacent slabs.

FIG. 7 is a detailed view, as a cross section along the line I—I of FIG. 6 of the link between two adjacent slabs. Each slab 5 is fitted, on its sides, with recesses 53 extending over a portion of the height of the slab in order to leave a lower portion in the form of a wall 54 forming an formwork. When placing two adjacent slabs, the walls 54*a*, 54*b* touch one another while delineating a rectangular space composed of recessed portions 53*a*, 53*b* in which standby reinforcements 55 extend. After placing the elements, transversal stirrups 56 are inserted into the reinforcements 55 and the assembly is embedded in cast concrete in the space 53*a*, 53*b* in order to form a continuous slab.

Furthermore, each slab 5 is fitted, at each girder 1, 1', with at least one recess 6 extending over the whole height of the slab 5 in order to open to a portion 14 of the upper face 11 of the girder 1 to which a number of pins 61 forming connectors, have been welded. Preferably, there are simply two types of slabs, respectively a running slab such as 5 and an abutment slab 5' placed at each end of the span and represented on FIG. 8. Normally, only one type of running slab is available and the length (1) covered by each slab does not correspond necessarily to the length (L) of the slabs. Consequently, when studying the span of the bridge to build, the location of the zones 14 of each girder 1 corresponding to the recesses 6 of the slabs will be determined and the pins 51 will be arranged on each elementary coffer 10 in relation of the position of the coffer in the span.

Advantageously, the lower walls 54 provided on the sides of each slab 5 will be fitted, at each supporting girder 1, with cutouts 62, as the corresponding zone of the upper face 11 of the girder 1 is fitted with connecting pins 61 in order to ensure interlocking with the girder, of two successive slabs at their junction.

Figure 8:
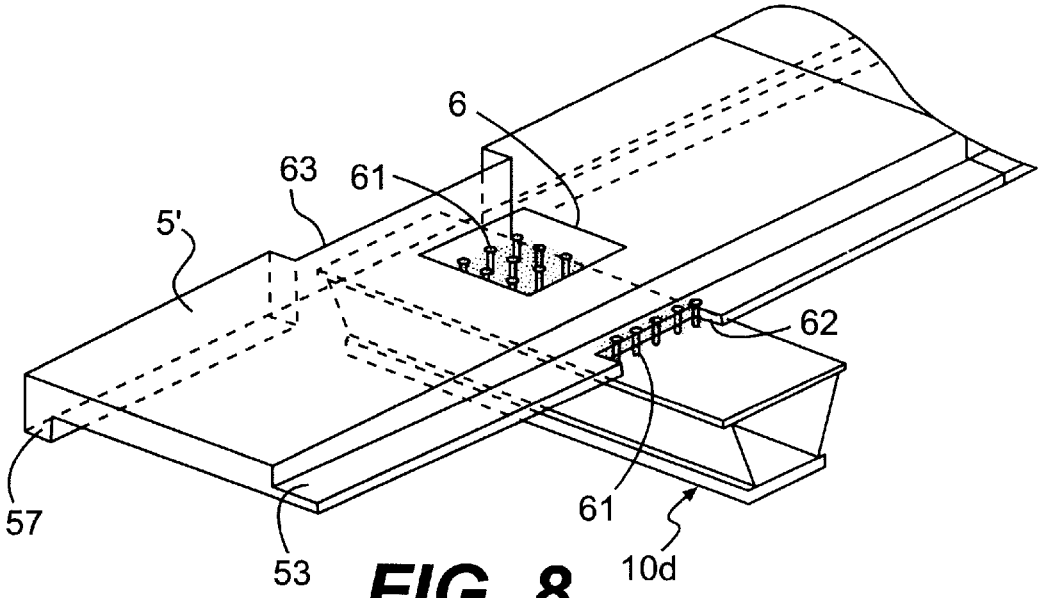
FIG. 8 is a perspective assembly view of a butting slab.
Figure 9:
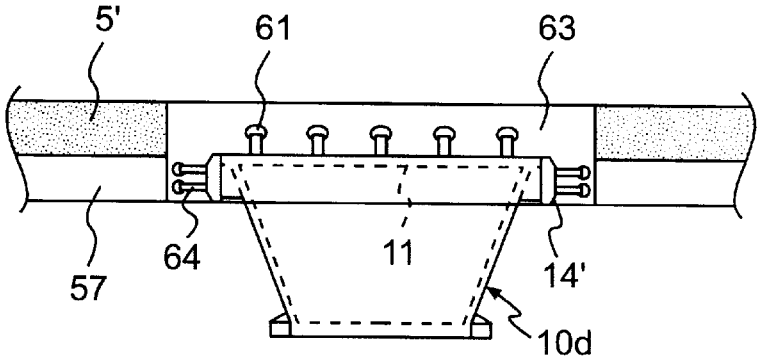
FIG. 9 shows, as a longitudinal cross section, the junction between a butting slab and the end of a longitudinal girder.

At its end turned toward the abutment, each girder 1 is terminated by a butting coffer 10*d* that is covered with a butting slab 5' represented in perspective on FIG. 8. This abutment slab is fitted, on its side turned toward the adjacent slab, with a transversal recess 53 and, on its side turned toward the abutment, with a stiffening girder 57, turned downwards and forming a ledge. At the coffer 10*d*, the girder 57 is fitted with a recess 63 in which connecting pins 61, 64, welded respectively on the upper face 11 of the coffer 10*d* and on both its lateral faces 14' provided at the end of the coffer 10*d*. Thus, using appropriate casings, it is possible to cast concrete into the recess 63 to complete the transversal girder 57 and ensure interlocking of the slab element 5*a* with the butting coffer 10*d*.

On the example represented on the figures, the bridge is composed of two spans resting on a pier 7 using a transversal girder 8 constituting an intermediate support.

According to another advantageous characteristic of the invention, each intermediate supporting girder 8 forms an interlocking keying between the ends of both spans, that is performed inside a coffer making up an expandable coffer and resting on the pier 7.

Figure 11:
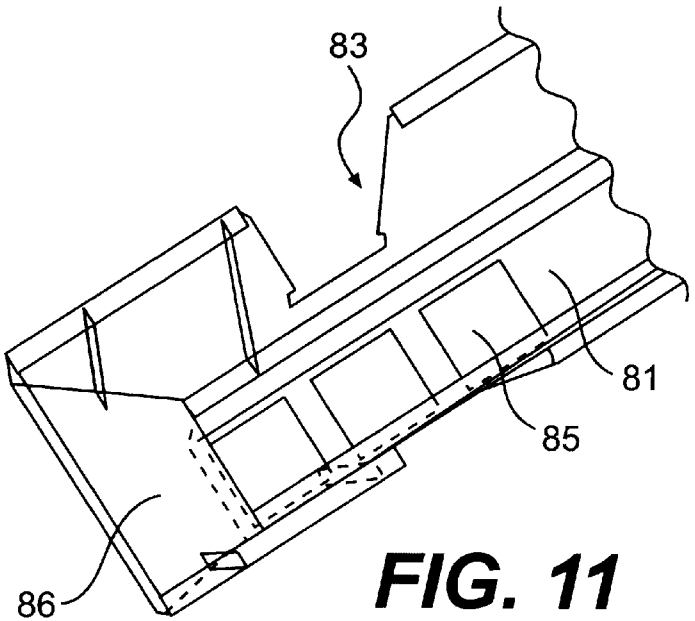
FIG. 11 is a perspective schematic view, of a coffer for casting a transversal resting girder.

This coffer 80, represented in perspective on FIG. 11, has the shape of a trough with a bottom 81, two lateral walls 82 in which are provided cutouts 83 whose profile matches that, as a transversal section, of a longitudinal girder 1, and two end walls 86.

Figure 10:
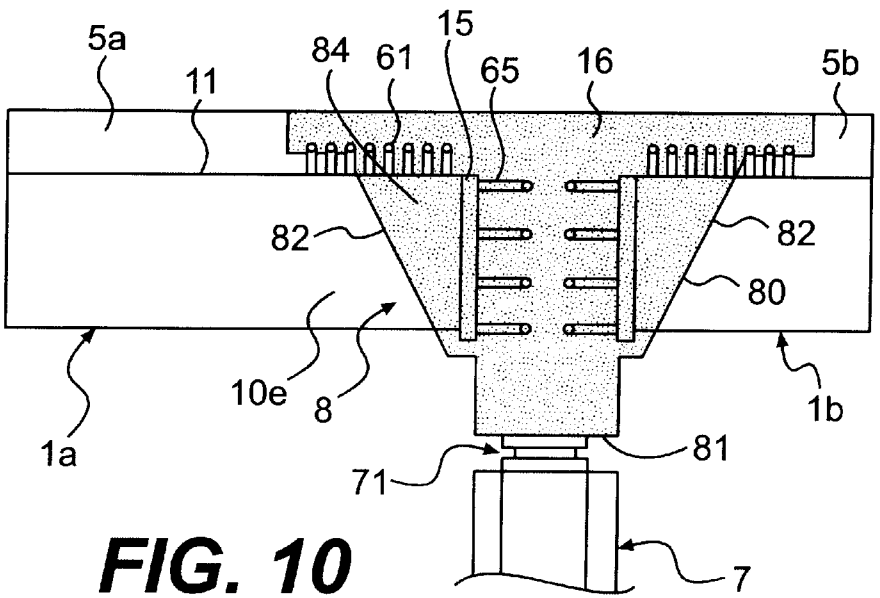
FIG. 10 is a detailed view, as a longitudinal cross section, of the junction between two successive spans, at a resting point.

Thus, as shown on FIG. 10, the end coffers 10*e* of two aligned girders 1*a*, 1*b* of two successive spans are connected inside the casing 80 via the cutouts 83. Both ends of both girders 1*a*, 1*b* are fitted with connector pins 61, 65 welded, respectively, to the upper face 11 of the coffer 10*e* and to a flange 15 fastened at the end of the coffer.

The upper edges of both lateral faces 82 of the coffer 80 are covered by the slabs 5*a*, 5*b* laid at the ends of the girders 1*a*, 1*b*. Concrete 16 can then be cast inside the coffer and up to the upper level of the slabs, in order to provide a transversal girder 84 interlocking both spans as well as a continuous flooring.

This transversal girder 84 rests on the pier 7 using supporting members 71 that can be of any known type, for example smooth or roller-fitted supports. Preferably, each support 71 is inserted, with a small clearance, into an opening 85 of matching profile, provided in the bottom 81 of the coffer 80 so that it rests directly upon the concrete. Obviously, the transversal girder 84 thus constituted can be fitted with adequate stirrups, in particular in its lower part, to ensure distribution of the load on the supports 71 and in its upper part, for the junction of the slabs 5*a*, 5*b*.

Figure 13:
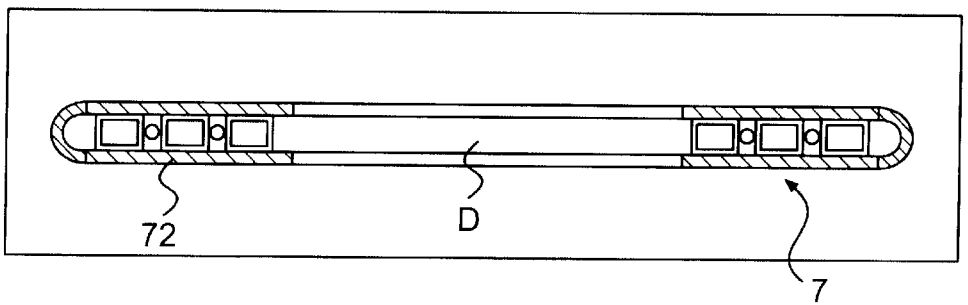
FIG. 13 is a cross sectional view along XIII—XIII of the FIG. 12.
Figure 14:
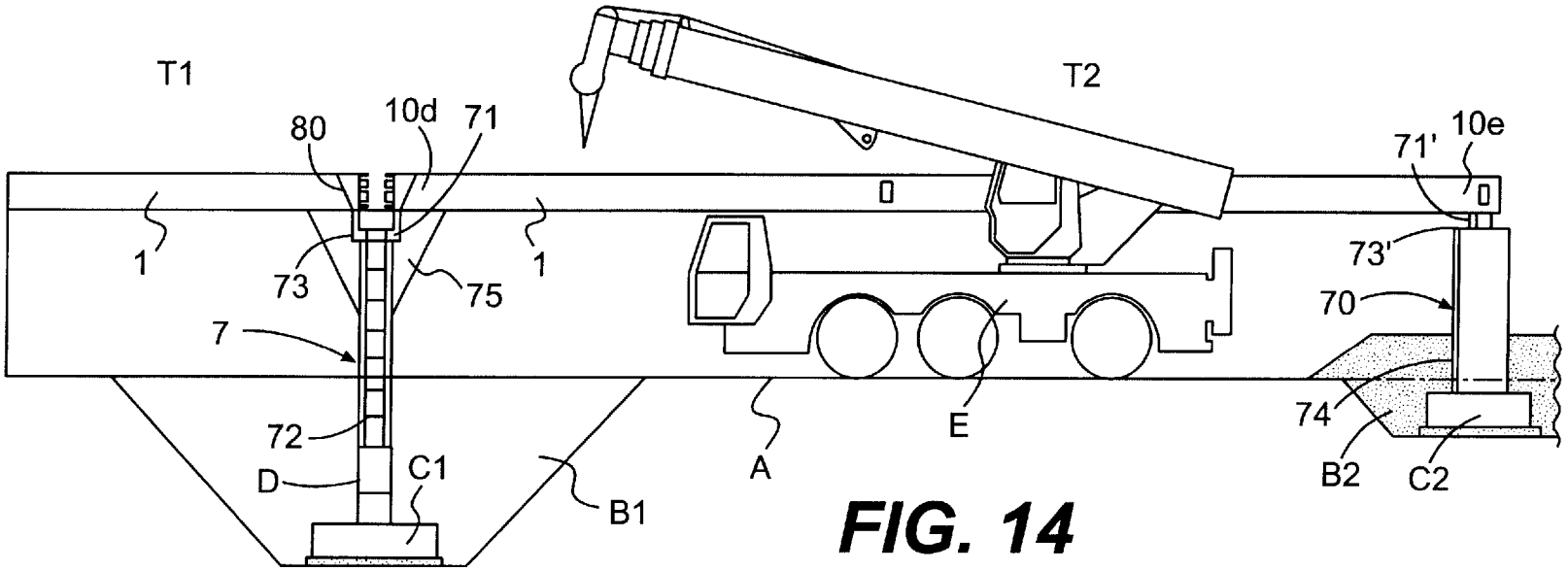
FIG. 14 and FIG. 15 illustrate two construction stages of a bridge according to the invention.
Figure 15:
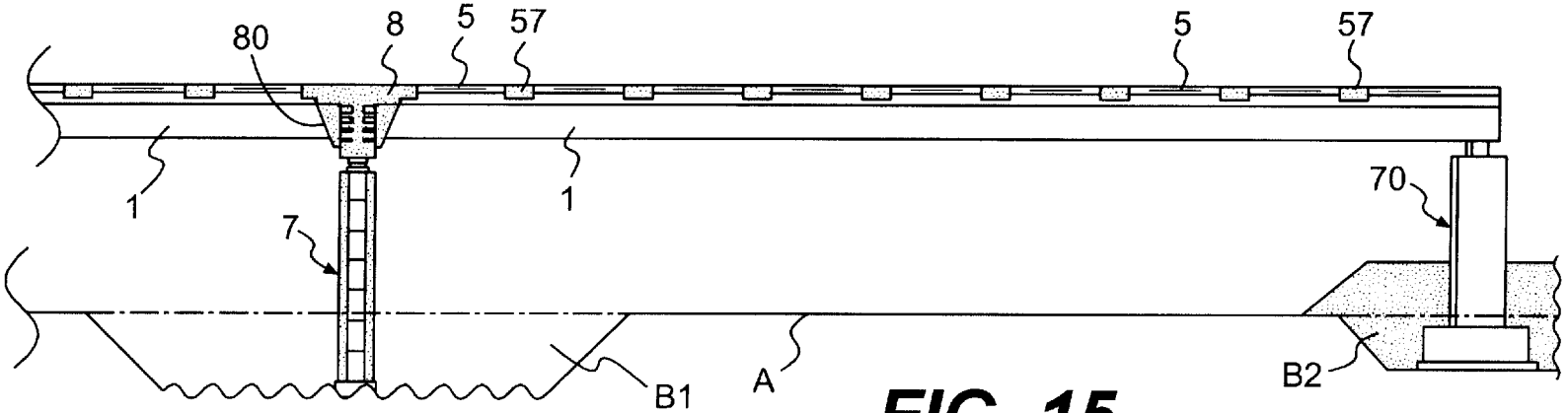

FIGS. 14 and 15 illustrate schematically the realization of a bridge according to the invention, resting on a pier 7 constituted as represented in detail on FIGS. 12 and 13.

On the example represented, the bridge constitutes an overpass over a two-lane highway provided on a platform A. After having repaired the terrain and provided this platform, a ditch B1 is dug first of all, up to the requested level for the foundation, for the center pier, two ditches B2 for the abutments. If the ground proves rather resistant, the foundation of the center pier may simply consist of a base C1 and, possibly, a headwall D made of concrete on which prefabricated elements 71 are laid, which consist advantageously of superimposed coffers, as represented on FIGS. 12 and 13. Internal stirrups enable interlocking the assembly with the headwall D up to the upper level 73 of the pier 7.

Similarly, each abutment can be made of superimposed elements 74, resting on the base C2. These elements 74 can be, for instance, U-shaped for maintaining an embankment up to the requested level.

Then, supports 71, 71' are laid respectively on the upper end 73 of the pier 7, at the upper level 73' of each abutment 70.

The pier 7 is then fitted with supports 75 fastened in a removable way and providing a provisional support for the transversal coffer 80 whose bottom is wedged at the requested level on the supports 71.

Meanwhile, the four supporting girders 1 have each been realized, by assembling interlocked, for instance pretensioned, longitudinal coffers 10.

A lifting vehicle E, for example a mobile crane, operating on the platform A, will then place the four longitudinal girders 1 in succession, whereas each girder has an end 10*d* resting on the support 71' of the abutment 70 and an opposite end 10*e* that can be inserted into a matching cutout 83 of the transversal coffer 80.

As stated on FIG. 15, using the lifting vehicle E, the different slabs 5 making up the flooring of the bridge are put in place and concrete may then be cast, on the one hand into the coffer 80 to form the transversal girder 8 resting on the pier 7 and, on the other hand, into each of the transversal joints 57 between two successive slabs.

Continuous flooring can thus be provided, with possible, as a transversal section, the profile represented on FIG. 12. The bridge may then be completed by adding pavement 42, as well a prefabricated curbstone 43 supporting a bridge railing.

It can therefore be seen that, using a small number of prefabricated metal elements, a bridge span can be realized rapidly and economically, either for a provisional construction as represented on FIG. 1, or for a permanent construction, whereas the flooring may also be composed of prefabricated elements.

But the invention is not limited, of course to the details of embodiments that have been described for exemplification purposed and that could be liable to variations without departing from the protection framework delineated by the claims.

For example, it is particularly advantageous to realize coffers with trapezoid section, but other shapes could be contemplated.

The reference signs inserted after the technical features mentioned in the claims solely aim at facilitating the understanding of the and do not limit their extent whatsoever.

What is claimed is:

1. A method of building a bridge including at least one span supported by two spaced supports, the span having at least two main longitudinal girders carrying a deck, the method comprising the steps of:

fabricating a plurality of longitudinal girders as tubular coffers of polygonal transverse section, with at least two parallel upper and lower plane faces, and at least two lateral faces, each coffer having a weight and a length compatible with machines to lift the girders;

fabricating a plurality a spacers of the same length, each having two ends fitted with fastening devices;

constructing two spaced supports on a construction site for at least one span of the bridge;

transporting the coffers and spacers to the site;

assembling, end to end, two series of at least two tubular coffers for building two main longitudinal girders;

transversally connecting the two girders by a plurality of spacers that are fastened, at opposite ends of the spacers, to oppositely confronting lateral faces of two opposite coffers;

placing the two connected main girders on the supports for building at least one span of the bridge;

interlocking longitudinally adjacent neighboring main girders by a plurality of rigid transverse junction elements distributed over the whole length of the span and constituting at least a part of the deck of the bridge covering the longitudinal girders, each junction element extending at least over a distance between both longitudinal girders and being fastened to the upper faces of both longitudinal girders.

2. A method of building a bridge according to claim 1, the method further comprising the steps of:

building at least two longitudinal girders of preselected length, each by assembling at least two coffers on the ground;

lifting and placing the two girders beside one another, on the supports; and connecting both girders by at least two spacers.

3. A method of building a bridge according to claim 1, the method further comprising the steps of:

constructing a first element of the span by constructing two coffers connected by two spacers;

resting the first element on the ground;

building a second element comprising two coffers connected by at least one spacer and fastening the coffers of the second element end to end to the coffers of the first element while on the ground; and gradually building both longitudinal girders of the span which rest on the ground, on their lower faces, and pushing them longitudinally as construction progresses to construct the whole span between the two supports.

4. A method according to claim 1, further wherein the junction elements are metal members each with two ends fastened, after installation, to the upper faces of two longitudinal girders, the members being spaced regularly by a distance equal to the width of a timber girder forming a span, and each gap between two junction element members being provided with flooring members on the upper faces of the two girders, to build a provisional platform.

5. A method according to claim 1, further comprising the steps of:

placing regularly spaced metal members forming junction elements, each with two ends, and fastening the ends to the upper faces of the coffers forming both longitudinal girders;

covering at least the space between the two longitudinal girders by abutment panels, each having ribs nesting into the junction element members;

casting a concrete slab on the surface made by the upper faces of the longitudinal girders connected by panels, whereby the panels form a formwork for casting the slab.

6. A method according to claim 1, further comprising the steps of providing protruding parts forming connectors on the upper plane face of each coffer; and embedding the connectors in the concrete slab which is cast on the panels for interlocking the longitudinal girders with the slab.

7. A method according to one of claim 1, further comprising the steps of:

providing a series of prefabricated concrete slab elements, each having two recesses, each recess extending over its whole height, the recesses being separated by a spacing corresponding to the spacing between both longitudinal girders;

butt-mounting a series of slab elements one after another on the upper faces of both girders, each recess of each slab opening onto a zone of the upper face of a longitudinal girder, the zone being fitted with protruding parts forming connectors extending into the recesses;

pouring concrete into the recesses for interlocking each slab element with both longitudinal girders by embedding the connectors.

8. A method according to claim 1, wherein the tubular coffers forming each longitudinal girder are interlocked by welding their adjacent ends .

9. A method according to claim 1, wherein the tubular coffers forming each longitudinal girder are interlocked by bolting their adjacent ends.

10. A method according to claim 1, wherein each tubular coffer forming an element of a longitudinal girder is fitted, at each of its ends, with enlarged connectors welded to the coffer;

drilling each enlarged connector with a bore and, when laying the coffers to abut against one another to construct a longitudinal girder, the enlarged connectors of two consecutive coffers being placed in adjacent alignment in order to install a pretensioning bar through the aligned bores, the bar being pretensioned for interlocking the aligned coffers.

11. A method according to claim 1, comprising the steps of:

placing a casing on each support of the bridge, the casing having the shape of a trough with a bottom resting on the support of the bridge, and two lateral walls as well as two end walls whereby the lateral walls are fitted with at least two cutouts, each cutout exhibiting the same profile as a longitudinal girder in transverse section;

introducing an end of each longitudinal girder inside the casing via a corresponding cutout;

pouring concrete inside the casing that serves as a formwork for producing a transverse girder interlocked with the ends of the longitudinal girders.

12. A method according to claim 9, wherein each longitudinal girder is fitted, at its end penetrating into the transverse girder, with protruding parts forming connectors, for interlocking the longitudinal girder with the transverse girder cast in the coffer.

* * * * *